United States Patent [19]

Dax

[11] Patent Number: 4,852,140

[45] Date of Patent: Jul. 25, 1989

[54] X-RAY TUBE BEARING ARC SUPPRESSOR

[75] Inventor: Mark Dax, Lombard, Ill.

[73] Assignee: Siemens Medical Systems, Inc., Iselin, N.J.

[21] Appl. No.: 61,906

[22] Filed: Jun. 11, 1987

[51] Int. Cl.[4] ..... H01J 35/04

[52] U.S. Cl. ..... 378/132; 378/125; 378/144; 200/144 R; 200/144 AP

[58] Field of Search ..... 378/125–133, 378/143, 144; 313/414; 200/144 R, 144 AP

[56] References Cited

U.S. PATENT DOCUMENTS

| | | | |
|---|---|---|---|
| 2,280,886 | 3/1941 | Brace . | |
| 3,855,492 | 12/1974 | Langer et al. | 378/125 |
| 4,097,759 | 6/1978 | Furbee et al. | 378/133 |
| 4,326,144 | 4/1982 | Appelt . | |
| 4,357,555 | 11/1982 | Gerkema . | |
| 4,413,355 | 11/1983 | Matsumoto . | |

FOREIGN PATENT DOCUMENTS 0945277 7/1956 Fed. Rep. of Germany ..... 378/132

OTHER PUBLICATIONS

*Static and Dynamic Electricity* 3rd Edition, Smythe (McGraw Hill 1968) pp. 76–79.

*Chilton's Auto Repair Manual,* 1975.

*Primary Examiner*—Carolyn E. Fields

*Assistant Examiner*—Joseph A. Hynds

*Attorney, Agent, or Firm*—Lawrence C. Edelman

[57] ABSTRACT

A structure for suppressing arcing in electric current carrying anti-friction bearings operating in a vacuum environment is disclosed having opposed spaced-apart surfaces forming an effective capacitor in parallel with the bearings responsive to temperature to reduce arcing which would otherwise result from current interruption in the bearings.

23 Claims, 1 Drawing Sheet

X-RAY TUBE BEARING ARC SUPPRESSOR

BACKGROUND OF THE INVENTION

This invention relates to electromechanical systems which require the conduction of electrical current through an anti-friction bearing operating in a vacuum environment. More particularly, this invention has particular advantage when incorporated into rotating anode x-ray tubes having ball bearings operating within races in the vacuum environment and which conduct the anode-cathode current of the tube.

Such systems have experienced limited life in the past, due in part to spark erosion of the bearings occasioned by random current interruption which has been observed to occur while the equipment is rotating. Although prior art systems, including x-ray tubes, have had opposing conductive surfaces which were relatively moveable, such prior art structures have been observed to have so little capacitance as to be ineffective to suppress arcing.

SUMMARY OF THE INVENTION

This invention provides for an arc suppressor for use with an electric current-carrying anti-friction bearing operating in a vacuum environment by providing closely spaced apart first and second conductive surfaces forming an effective capacitance in parallel with the bearing, with one surface moveable with respect to the other surface while still acting like a capacitor to reduce arcing in the event of current interruption in the bearing. A further feature of the invention is that the effective capacitance increases with increases in the ambient temperature of the capacitance.

It has been found preferably to have the square root of the opposing area of the capacitance surfaces or plates be large in relation to the distance between the capacitance plates.

DETAILED DESCRIPTION

Figure 1:
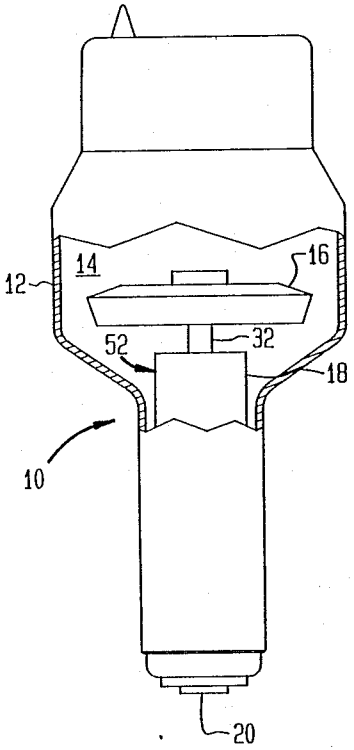
FIG. 1 is a partially cut away view of a rotating anode x-ray tube.

FIG. 1 shows a rotating anode x-ray tube 10. Tube 10 has a glass envelope 12 which provides a vacuum environment or interior 14 in which an anode 16 is mounted for rotation.

Figure 2:
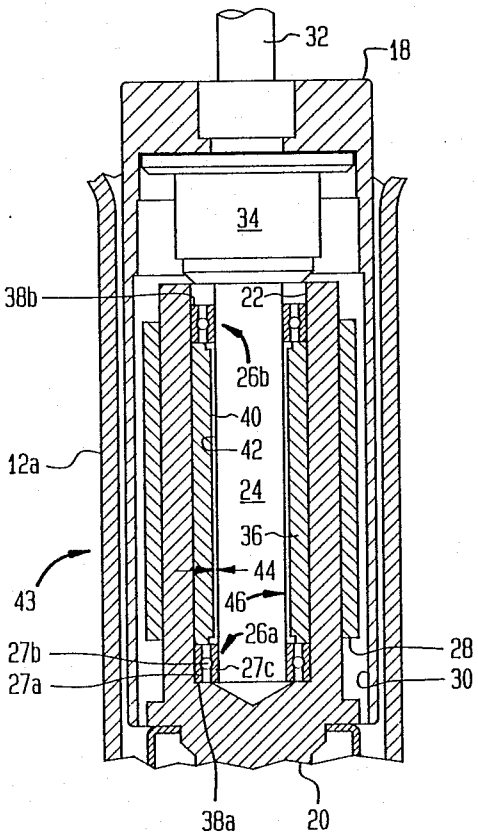
FIG. 2 is a partial cut away section view of the rotor mounting of FIG. 1 showing a sleeve member mounted to the stationary portion of the tube.

Referring now to both FIGS. 1 and 2, anode 16 is mechanically and electrically connected to rotor 18 and is caused to rotate by a stator (not shown) which couples a rotating field across envelope wall 12a. Electrical connection is made to anode 16 through an anode shank or stud 20. It is to be understood that anode shank 20 has an interior cylindrical aperture 22 which receives and mounts an anode shaft 24 by means of bearings 26*a,b*. A torque sleeve 28 preferably having high magnetic permeability is mounted on the interior surface of 30 of rotor 18. A stub shaft 32 connects anode 16 to rotor 18. A heat stop 34 preferably connects rotor 18 to anode shaft 24.

It is to be understood that stud 20 is electrically conductive and is mechanically bonded to wall 12*a* to maintain the vacuum integrity of the envelope interior 14. Bearings 26*a,b*, shaft 24, heat stop 34, rotor 18, and stub shaft 32 are all formed entirely or partiallly of electrically conductive material to provide for a current path to anode 16. Alternatively, only one bearing may be utilized to conduct electrical current with this invention, in applications having only one ball bearing assembly or where the second bearing is electrically insulated from the current carrying path. For example, bearing 26*b* may be electrically insulated and bearing 26*a* may be utilized to conduct electric current from shank 20 through an outer race 27*a* of bearing 26*a*, one or more balls or rolling elements 27*b*, and an inner race 27*c* to shaft 24.

As may be seen in FIGS. 1 and 2, anode 16, rotor 18, and associated rotatable parts make up a mechanical assembly 52 mounted for movement on inner bearing race 27*c*. It is to be understood that this invention has utility in any application requiring conduction of electrical current across a bearing to a mechanical assembly operating in a vacuum environment.

Referring now more particularly to FIG. 2, a conductive spacer sleeve 36 is mounted on the stationary anode shank 20. Sleeve 36 is preferably retained between bearing outer races 38*a,b*. Sleeve 36 has an inner cylindrical wall 40 which is in spaced apart opposed relationship to outer cylindrical surface 42 of shaft 24. An effective dielectric gap or distance 44 is formed between wall 40 and surface 42 by this construction which results in an effective capacitance or arc suppressor 43 in parallel with each of bearings 26*a,b*. In the event that current flowing through bearings 26*a,b* is interrupted, the capacitor 46 (formed by the common or shared opposing area of wall 40 and surface 42 acting as plates for capacitor 46) prevents a rapid rise in voltage across the bearings 26*a,b*, thus reducing or eliminating arcing which would otherwise occur in bearings 26*a,b*. It has been found preferable to have the ratio of the shared opposing area to the square of the distance 44 between wall 40 and surface 42 be as large as practicable. Making this ratio large will tend to maximize the high frequency bypass path formed in parallel with the open-circuit bearing, thus limiting the rate of rise of voltage across the bearing, reducing or eliminating arcing which would otherwise occur.

In order to provide for normal machining tolerances and to allow for thermal expansion, gap 44 is preferably in the range of 0.002 and 0.010 inches. It is a feature of this invention that the effective capacitance increases as the tube anode temperature increases. Since shaft 24 is connected to a high temperature anode 16, during operation as tube 10 heats up, shaft 24 will "grow" due to thermal expansion relative to sleeve 36 and shank 20. This will cause gap 44 to decrease, raising the effective capacitance.

Figure 3:
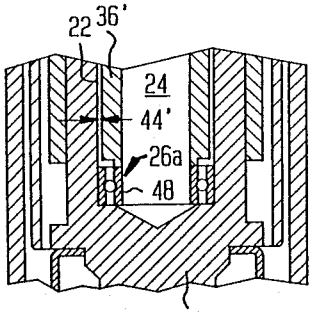
FIG. 3 shows an alternative embodiment showing the sleeve member mounted for rotation with the anode mounting shaft.

Referring now more particularly to FIG. 3, an alternative embodiment of this invention provides for mounting sleeve 36' on inner race 48 for rotation with shaft 24. Distance 44' is the gap between spacer sleeve 36' and inner cylindrical wall 22 in shank 20.

Figure 4:
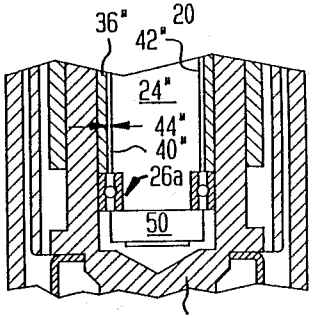
FIG. 4 shows a further alternative embodiment for the present invention having a portion of the shaft enlarged in diameter and a sleeve mounted to the stationary part of the tube.

Referring now more particularly to FIG. 4, a further alternative embodiment provides for a spacer 36'' mounted in a fashion similar to spacer 36 of FIG. 2. Gap 44'' is formed between spacer 36'' and an enlarged outer cylindrical surface 42'' of shaft 24''. In this embodiment one plate of the capacitor 46 is formed by surface 40''. A bearing retainer stop ring 50 may be mounted on the end of shaft 24'' to prevent axial movement of bearing 26a.

Figure 5:
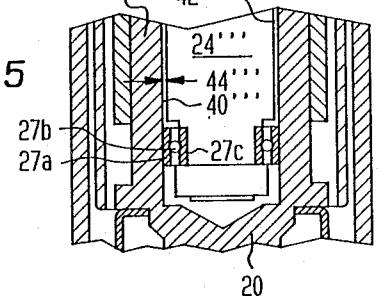
FIG. 5 shows still a further embodiment of this invention having a portion of the rotating equipment enlarged in diameter sufficient to eliminate the need for a sleeve.

Referring now more particularly to FIG. 5, a still further alternative embodiment of this invention permits elimination of the spacer sleeve by enlarging outer cylindrical surface 42''' to provide for distance 44''' between shaft 24''' and shank 20'''. It is to be understood surfaces 40''' and 42''' are electrically conductive.

The capacitance between two concentric cylinders is given by equation (1), where C is capacitance per unit length, and $R_1$ and $R_2$ are the radii of the outer and inner cylinders, respectively and $\epsilon$ ($8.85\times10^{-12}$ farads/meter) is the permittivity of free space.

$$C = \frac{2\pi\epsilon}{\cosh^{-1}\left[\frac{R_1^2 + R_2^2}{2R_1R_2}\right]} \quad (1)$$

A generalized version of equation (1) may be found at Page 76–78 of *Static and Dynamic Electricity,* Smythe, McGraw-Hill (1968).

Equation (1) may be simplified to Equation (2), again where C is the capacitance per unit length, and 1nP is the natural log of the ratio or proportion P of the outer cylinder radius to the inner cylinder radius $R_1/R_2$.

$$C = \frac{2\pi\epsilon}{\ln P} \quad (2)$$

A simple approximation formula for the capacitance (in farads) of two closely-spaced concentric cylinders is given by equation (3), where D is the mean diameter of the cylindrical dielectric gap, d is the length of the gap (from plate-to-plate) and l is the cylinder length, all in meters.

$$C = \frac{2\pi\epsilon Dl}{d} \quad (3)$$

The invention is not to be taken as limited to all the details thereof as modifications and variations thereof may be made without departing from the spirit or scope of the invention. For example, the effective gap or distance 44 between members forming the effective capacitance of this invention may take various forms such as being stepped or tapered. There will, however, be an effective gap or distance equivalent to any such more intricate mechanical shapes. Furthermore, the geometry of the plates of the effective capacitor shunting the bearing may take various geometric shapes such as concentric cylinders or cones or parallel and opposing disks, provided that one plate of the capacitor is free to move with respect to the other plate without substantially changing the effective distance therebetween. It is to be understood that it is within the scope of this invention to have plates that may be non-concentric or non-parallel resulting in a gap which varies as a function of angular position with respect to the axis of rotation of the movable plate since such an arrangement will still have an equivalent or effective dielectric gap between such plates. It is to be further understood that it is within the scope of this invention to have a capacitance which varies as a function of the rotational position of the movable plate in a structure which is not angularly restricted, provided that the minimum capacitance contributes significantly to reducing arcing in the bearing or bearings which would otherwise occur.

What is claimed is:

1. An arc suppressor for use with an electric-current-carrying anti-friction bearing operating in a vacuum environment having a varying temperature gradient, comprising:

closely spaced first and second generally concentric conductive surface means nominally spaced apart from each other by an amount in the range from 0.002 inches to 0.010 inches for forming an effective capacitance connected in parallel with said bearing for reducing arcing resulting from current interruption in said bearing, said first surface means being movable with respect to said second surface means, said first surface means being located within said second surface means, and said first surface means being thermally connected to a higher temperature than said second surface means such that said effective capacitance will increase with an increase in said temperature gradient.

2. The arc suppressor of claim 1, wherein:

said bearing has a first and a second bearing race;

said first surface means is mechanically and electrically connected to said first being race; and said second surface means is mechanically and electrically connected to said second bearing race.

3. The arc suppressor of claim 2, wherein:

said surface means are each characterized by a common surface area having a square root which is relatively large in comparison to the distance said surface means are spaced apart.

4. The arc suppressor of claim 3, wherein:

said first surface means comprises a conductive surface of a mechanical assembly mounted for movement on said first bearing race.

5. The arc suppressor of claim 4, wherein:

said second surface means comprises a conductive surface of a mechanical assembly on which said second bearing race is mounted.

6. The arc suppressor of claim 5, wherein:

said first and second surface means comprise concentric conductive cylinders.

7. An arc suppressor for a ball bearing assembly conducting electric current to a rotating anode in an x-ray tube, comprising:

an effective two-plate capacitor connected across the ball bearing assembly, a first plate of the effective capacitor being connected electrically to a stationary part of the tube and a second plate of the effective capacitor being connected electrically to the rotating anode, wherein the effective capacitor provides a high frequency bypass path around the ball bearing assembly so as to reduce arcing in the bearing assembly, and further wherein the plate-to-plate distance of the effective capacitor is nominally in the range from 0.002 inches to 0.010 inches and decreases as the anode heats up such that the capacitance of the effective capacitor increases with increase in the temperature of the rotating anode.

8. The arc suppressor of claim 7, wherein:
said first and second plate comprise first and second conductive cylindrical surfaces, respectively, which are movable relative to each other.

9. The arc suppressor of claim 8, wherein:
one of said cylindrical surfaces comprises conductive sleeve means which reduces a dielectric gap distance between said plates.

10. The arc suppressor of claim 9, wherein:
one of said cylindrical surfaces comprises a portion of a shaft used for rotating said rotating anode.

11. An improvement for use with an anti-friction bearing of the type carrying at least one electrically conductive rolling element between a first and a second race, wherein the bearing conducts electrical current from said first race through said rolling element to said second race and operates in a varying-temperature vacuum environment, the improvement comprising:
an effective capacitive circuit having a first and a second plate connected in parallel across said bearing, said first plate being connected to said first race and said second plate being connected to said second race such that said first plate is free to rotate with respect to said second plate and further such that the distance between the plates is nominally in the range from 0.002 inches to 0.010 inches and decreases as the temperature difference between the plates increases.

12. The capacitive circuit of claim 11, wherein:
at least one of said plates comprises an electrically conductive sleeve means connected to one of said bearing races for reducing the effective plate-to-plate spacing of said capacitance circuit.

13. The capacitive circuit of claim 12, wherein:
said first and second bearing races comprise inner and outer races, respectively, and said sleeve means is connected to said inner race.

14. The capacitive circuit of claim 12, wherein:
said first and second bearing races comprise inner and outer races, respectively, and said sleeve means is connected to said outer race.

15. An arc suppressor for use with an electric current carrying anti-friction bearing operating with a temperature differential in a vacuum environment, comprising:
an effective capacitor having first and second plates, with said first plate being movable with respect to said second plate, the effective capacitor being connected in parallel with said bearing such that arcing resulting from current interruption in said bearing is reduced and further such that the plate-to-plate distance of said effective capacitor is nominally in the range of 0.002 inches to 0.010 inches and varies inversely to the temperature differential across said bearing.

16. The arc suppressor of claim 15, wherein:
said bearing has first and second bearing races and said first and second plates comprise two first and second conductive surface means relatively large in relation to said plate to plate distance, said first surface means being mechanically and electrically connected to said first bearing race and said second surface means being mechanically and electrically connected to said second bearing race.

17. The arc suppressor of claim 15, wherein:
said plates are formed by two conductive surface areas of equipment which are relatively large in relation to said plate to plate distance and are supported by said bearing, with one area being rotatable and one area being stationary with respect to said equipment.

18. The arc suppressor of claim 17, wherein:
said surface areas are characterized by a common opposing area.

19. The arc suppressor of claim 18, wherein:
said common opposing area has an effective dielectric gap distance.

20. A thermally-responsive arc suppressor for a ball bearing assembly in a rotating anode x-ray tube, said ball bearing assembly conducting electric current between a stationary part which attains a relatively lower temperature and a moving part which attains a relatively higher temperature during operation of the rotating anode x-ray tube, comprising:
an effective capacitor connected across the ball bearing assembly and having first and second plates spaced apart from each other in the range from 0.002 inches to 0.010 inches when the x-ray tube is not operating, with said first plate connected electrically to the stationary part and said second plate connected electrically to the moving part such that the effective capacitor provides a high frequency bypass across the ball bearing assembly and wherein a capacitance of the capacitor increases as tube operating temperature increases, thereby reducing electrical arcing in the ball bearing assembly and bearing erosion caused thereby.

21. A method of suppressing electrical arcing in an anti-friction bearing of the type carrying a plurality of rolling elements between first and second races, the bearing conducting electrical current from one race through the rolling elements to the other race and operating in a vacuum environment having a varying operating temperature, comprising:
shunting high frequency components of the electrical current around the anti-friction bearing by an effective capacitive circuit having first and second plates connected in parallel across said bearing, with said first and second plates connected to said first and second races, respectively, and the plates are free to move with respect to each other without substantial change in the capacitance of said capacitive circuit as a function of such relative movement; and
spacing said plates together such that said plates share a common opposing area for forming an effective capacitor having an effective plate-to-plate distance nominally in the range from 0.002 inches to 0.010 inches.

22. An arc suppressor for use with an electric-current carrying anti-friction bearing, comprising:
closely spaced first and second generally concentric conductive surface means nominally spaced apart from each other by an amount in the range from 0.002 inches to 0.010 inches for forming an effective capacitance connected in parallel with said bearing for reducing arcing resulting from current interruption in said bearing, said first surface means being movable with respect to said second surface means, and said first surface means being located within said second surface means.

23. A thermally-responsive arc suppressor for a ball bearing assembly conducting electric current between a stationary part which attains a relatively lower temperature and a moving part which attains a relatively higher temperature during operation of the ball bearing assembly, comprising:

an effective capacitor connected across the ball bearing assembly and having first and second plates nominally spaced apart from each other in the range from 0.002 inches to 0.010 inches when the ball bearing assembly is not operating, with said first plate being connected electrically to the stationary part and said second plate being connected electrically to the moving part such that the effective capacitor provides a high frequency bypass across the ball bearing assembly and wherein a capacitance of the capacitor increases as a temperature differential between said stationary and moving parts increases, thereby reducing electrical arcing in the ball bearing assembly and bearing erosion caused thereby.

* * * * *